US007389663B2

(12) United States Patent
Cheppe et al.

(10) Patent No.: US 7,389,663 B2
(45) Date of Patent: Jun. 24, 2008

(54) ACOUSTIC SHOT PEENING METHOD AND APPARATUS

(75) Inventors: Patrick Cheppe, Basse Goulaine (FR); Vincent Desfontaine, Saint Lumine de Coutais (FR); Jean-Michel Duchazeaubeneix, Les Sorinieres (FR); Philippe Jacob, Orvault (FR)

(73) Assignee: Sonats-Societe des Nouvelles Applications des Techniques de Surfaces, Carquefou (FR)

( * ) Notice: Subject to any disclaimer, the term of this patent is extended or adjusted under 35 U.S.C. 154(b) by 0 days.

(21) Appl. No.: 11/637,747

(22) Filed: Dec. 13, 2006

(65) Prior Publication Data

US 2008/0092616 A1 Apr. 24, 2008

(30) Foreign Application Priority Data

Oct. 20, 2006 (FR) ..... 06 54428

(51) Int. Cl.
*B24C 1/00* (2006.01)
*C21D 7/00* (2006.01)

(52) U.S. Cl. ..... 72/53; 451/39; 451/40

(58) Field of Classification Search ..... 72/53; 451/38, 39, 40

See application file for complete search history.

(56) References Cited

U.S. PATENT DOCUMENTS

| | | | | |
|---|---|---|---|---|
| 6,289,705 | B1 * | 9/2001 | Duquenne et al. | 72/53 |
| 6,336,844 | B1 * | 1/2002 | Duquenne et al. | 451/36 |
| 6,343,495 | B1 | 2/2002 | Cheppe et al. | |
| 6,490,899 | B2 * | 12/2002 | Berthelet et al. | 72/53 |
| 6,505,489 | B2 * | 1/2003 | Berthelet et al. | 72/53 |
| 6,508,093 | B2 * | 1/2003 | Berthelet et al. | 72/53 |
| 6,606,892 | B2 * | 8/2003 | Fischer et al. | 72/53 |
| 6,837,085 | B2 * | 1/2005 | Berthelet et al. | 72/53 |
| 2002/0042978 | A1 | 4/2002 | Cheppe et al. | |
| 2003/0130101 | A1 | 7/2003 | Hwang | |
| 2006/0021410 | A1 | 2/2006 | Cheppe et al. | |

FOREIGN PATENT DOCUMENTS

| | | |
|---|---|---|
| FR | 2 815 280 | 4/2002 |
| WO | WO 2006/124616 A2 | 11/2006 |

* cited by examiner

*Primary Examiner*—David B Jones
(74) *Attorney, Agent, or Firm*—Oliff & Berridge, PLC

(57) ABSTRACT

The present invention provides a method of shot peening at least a portion of a rotary machine comprising a rotor. Shot peening is carried out with a rotor which is at least partly assembled. The method includes fixing a system for supporting at least one acoustic assembly to the machine; and shot peening at least one region of the machine using projectiles which are moved by the acoustic assembly.

30 Claims, 10 Drawing Sheets

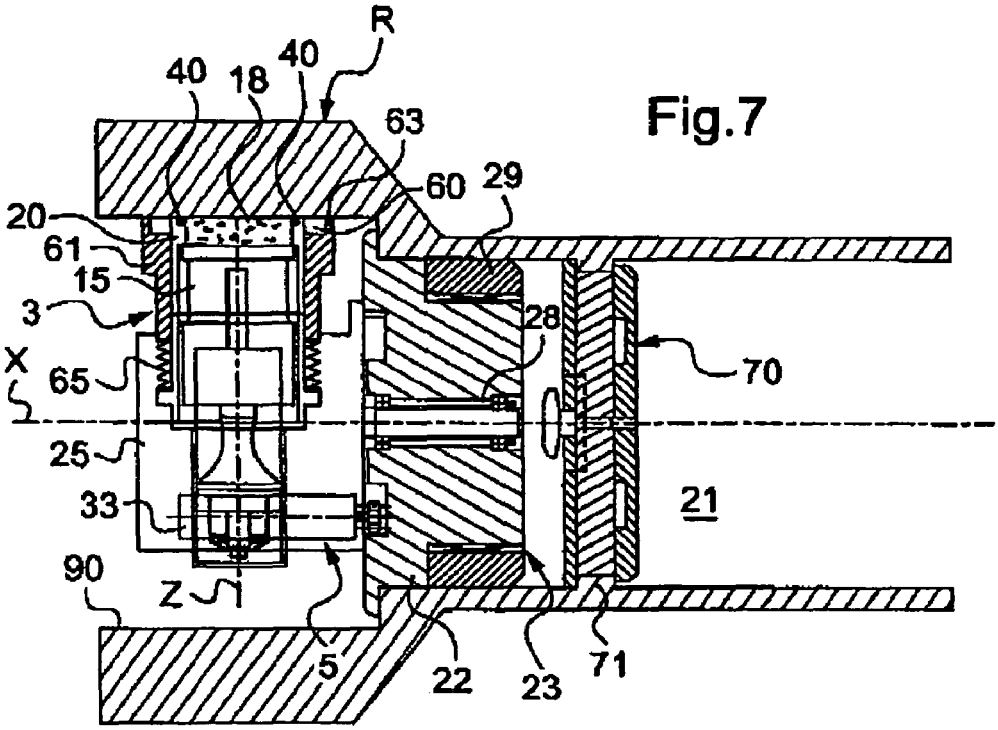
Fig.7
Fig.8
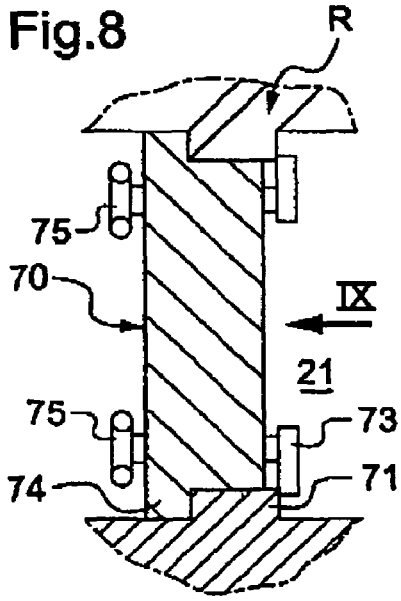
Fig.9
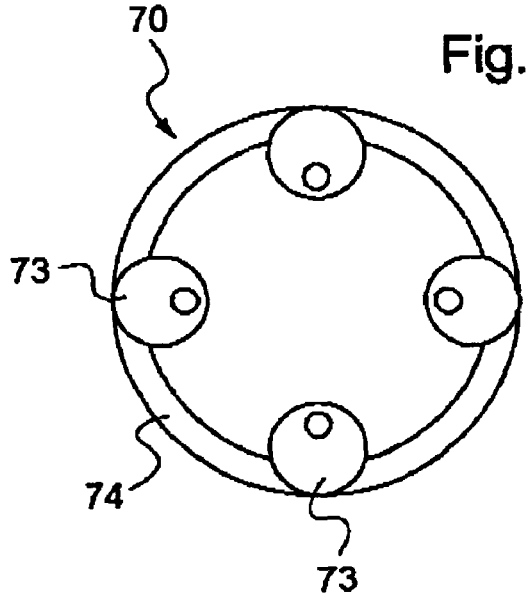

Fig.10
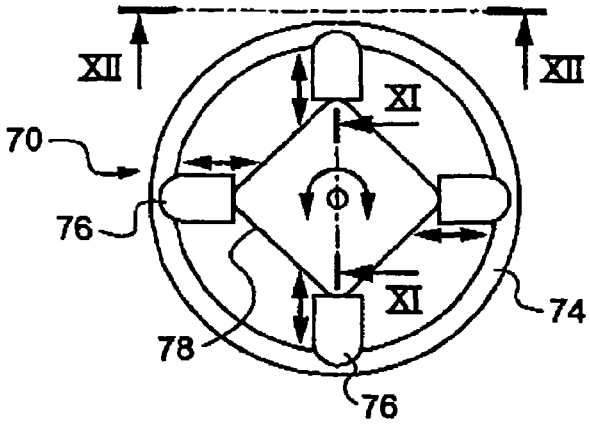
Fig.11
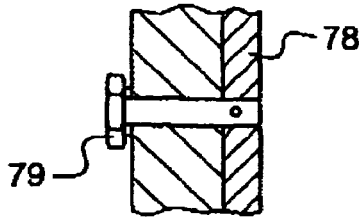
Fig.12
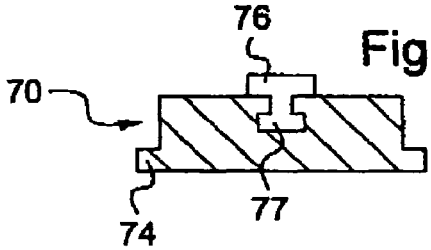
Fig.13
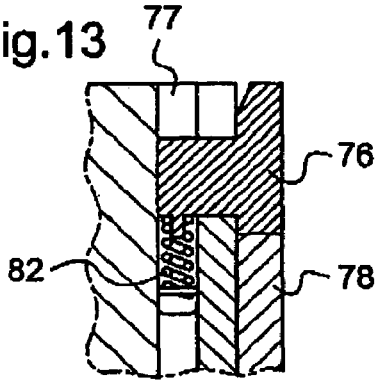
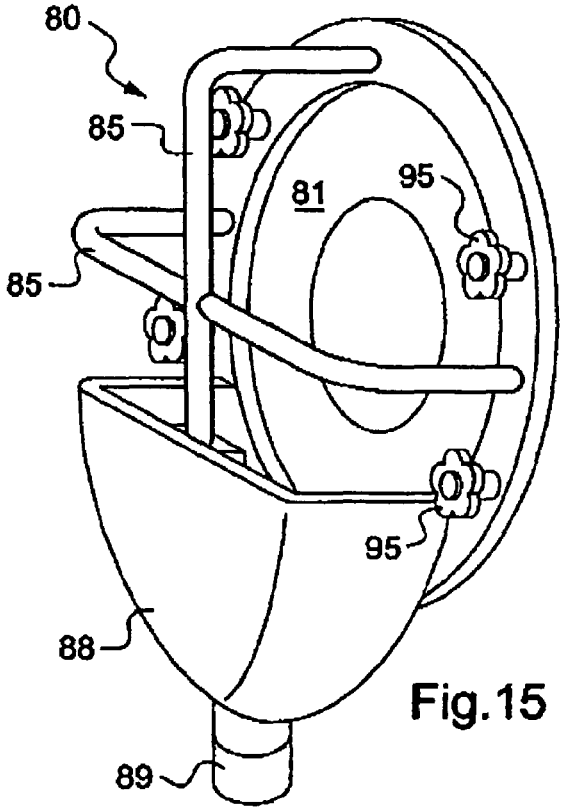
Fig.15
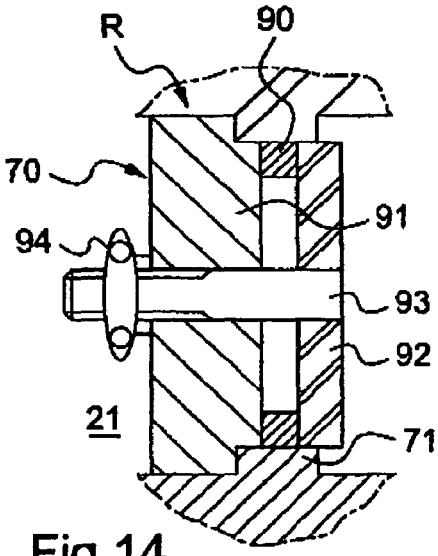
Fig.14

ACOUSTIC SHOT PEENING METHOD AND APPARATUS

This non provisional application claims the benefit of French Application No. 06 54428 filed on Oct. 20, 2006.

FIELD OF INVENTION

The present invention relates to shot peening methods and units comprising an acoustic assembly and projectiles set into motion by the acoustic assembly.

BACKGROUND

U.S. Pat. No. 6,343,495 discloses a portable device for local shot peening of a part to introduce compressive stress or to modify its surface quality.

United States application US 2002-0042978, French patent FR-A-2 815 280 and US 2006-0021410 disclose units in which the part to be treated is at least partly introduced into the unit.

Such units are suitable when treating component parts of a machine during fabrication thereof or when maintaining it after dismantling the machine completely.

SUMMARY

Whenever stopping the machine is expensive, a need exists for shortening, as far as possible, the duration of a maintenance operation involving shot peening.

The invention seeks to satisfy this need, inter alia.

Thus, in one aspect, the invention provides a method of shot peening at least a portion of a rotary machine comprising a rotor, in which shot peening is carried out with the rotor being at least partly assembled, the method comprising:

fixing a system for supporting at least one acoustic assembly to the machine; and shot peening at least one region of the machine using projectiles which are brought into motion by the acoustic assembly.

The treatment may be carried out on site, for example in a power station or close to an aircraft provided with the machine, or in a factory, but in both circumstances on a rotor that is at least partly assembled.

Down time may thus be reduced since the machine does not have to be completely dismantled.

The term "rotor that is at least partly assembled" means that the rotor is not removed completely from the stator of the machine, or that the rotor is not mounted in the stator but is not completely dismantled, the treated rotor part being assembled with other rotor components such as one or more disks or housings and/or shafts and/or cables, for example. The rotor may comprise, during the shot peening treatment, at least the majority of the components it possesses when the rotor is in position ready to operate in the rotary machine.

The treatment may, for example, be aimed at introducing compressive stresses to prevent cracks from propagating in the part in its existing shape, or after fresh machining thereof to repair it or modify its shape.

The rotor may optionally include, at its periphery, recesses for fixing blades (also termed fins or vanes) by mechanical cooperation between each recess and the root of the corresponding blade.

In the presence of blades, the support system may be fixed on the rotor in a manner that differs from using the current recess to be treated, for example in a recess adjacent to the current recess.

In one exemplary embodiment, the support system comprises a hinge that allows the acoustic assembly to rotate about at least one axis of rotation which may coincide with that of the rotor. The acoustic assembly may, for example, be displaced in rotation through at least 360° about the axis of rotation of the rotor as a function, for example, of the shape and the position of the region to be treated.

The method of the invention may be suitable, for example, for treating a gas or steam turbine rotor, for example an aircraft turbine or a ground-based turbine.

The treated region comprises, for example, an edge defined by the junction between a surface of the rotor that is transverse, for example perpendicular, to the axis of rotation and a surface of revolution about the axis of rotation, for example a cylindrical or conical surface. To treat such a region, the acoustic assembly may be positioned facing the edge and driven in rotation along it.

The acoustic assembly comprises a vibrating surface from which projectiles ricochet, which surface may, for example, be planar, concave, convex, conical, pyramidal, in the shape of a bowl, or otherwise. A normal to the vibrating surface may, for example, be orientated at about 45° relative to the axis of rotation of the rotor. Other orientations are possible as a function of the shape of the vibrating surface and that of the treated region.

If necessary, the orientation of the vibrating surface relative to the axis of rotation of the rotor may vary with time in order, for example, to be able to treat a complex shape more easily.

The treated region may also be located on a central bore of the rotor or elsewhere, for example in a peripheral recess, on a leading edge of the rotor or stator, on a vane, for example a vane of a one-piece rotor and more generally on any surface that requires local or complete shot peening treatment, for example a surface that may optionally extend over one complete turn. The method of the invention may, where appropriate, be limited to local retouching.

The acoustic assembly may optionally function constantly during treatment of the region concerned.

Depending on circumstances, for example when treating peripheral recesses, at least one first treatment of a first region of the machine, for example a first recess, may be carried out followed by a second treatment which may be carried out on a second region of the machine, for example a second recess, which is spaced circumferentially from the first region, and with a relative displacement being performed between the machine and the acoustic assembly between the two treatments, the acoustic assembly not operating between the two treatments.

Several acoustic assemblies may function simultaneously, where appropriate. An acoustic assembly may comprise one or more sonotrodes.

An acoustic assembly may, for example, comprise a plurality of sonotrodes disposed side by side to treat an extended region, for example to treat the entire length of a recess. Where appropriate, the axes of the various acoustic stacks associated with the sonotrodes are not co-planar in order, for example, to be able to treat a recess extending along a longitudinal axis that is curvilinear. The axes of the various acoustic stacks may be mutually parallel.

The sonotrodes may belong to respective acoustic stacks that are, for example, carried by a common part. An acoustic stack may be fixed to said part at a vibration node. The sonotrodes may have vibrating surfaces against which the projectiles will impinge, which surfaces are elongate in shape, for example rectangular.

The major axes of two adjacent vibrating surfaces which are, for example, substantially rectangular in shape, may form an angle. A wedge-shaped seal may be disposed between two adjacent sonotrodes to prevent projectiles from becoming stuck between the sonotrodes.

The use of a plurality of sonotrodes with substantially rectangular-shaped vibrating surfaces may have the advantage of performing treatment with relatively high intensity.

The support system may in general be fixed either on the stator or on the rotor. However, fixing on the rotor may be preferable in some situations, for example when it is the rotor that is to be treated.

The support system is, for example, fixed in a central bore of the rotor, if such a bore exists.

Fixing in a central bore may simplify rotating the acoustic assembly about the axis of rotation of the rotor. Where appropriate, this may also allow the use of a support to plug the bore and prevent projectiles from accidentally penetrating inside the machine.

Fixing may also be carried out on a peripheral recess if at least part of one or more peripheral recesses are to be treated.

In one example, proper positioning of the support system on the rotor, for example in the central bore, in a recess or elsewhere, is detected automatically and operation of the acoustic assembly or assemblies is inhibited if positioning is poor.

Automatic detection may further reduce the time taken for the operation, by reducing the number of verification steps which the operator must carry out before introducing projectiles and/or before switching on the acoustic assembly or assemblies.

Any detection means may be used for this purpose based, for example, on using one or more resistive, capacitative, inductive, optical, or other sensors or contactors.

The support system may include a motor to displace the acoustic assembly relative to the rotor, for example in rotation. In a variation, the acoustic assembly may be displaced manually. Displacement of the acoustic assembly, for example driving it in rotation, may be carried out continuously or incrementally.

The motor may be stationary relative to the machine. In a variation, the motor may be movable relative to the machine, for example mounted in a part of the support system that displaces with the acoustic assembly, for example rotating therewith.

The support system may come into contact with the machine over a relatively extended surface. In a variation, contact may be a point contact, for example at at least three points if centering is envisaged.

The support system may include a first portion which is stationary relative to the machine and a second portion which is movable relative to said first portion with at least one hinge interposed between the stationary and movable portions, the acoustic assembly being carried by the second portion. Where appropriate, the support system is arranged to allow adjustment of the centering of the second portion relative to the first portion. The above-mentioned hinge may include one or more bearings.

The support system may include means for detecting movement of the second portion relative to the first portion, for example an encoder.

The support system may be fixed on the rotor in order to treat a region of the stator. Where appropriate, displacement of the acoustic assembly may result from displacement of the rotor relative to the stator.

When the rotor comprises a central bore, which may be the case, for example, with a rotor of an airplane engine, it may be advantageous to dispose a safety barrier in said central bore to reduce the risk of projectiles escaping through the central bore into the machine, making it necessary to dismantle the machine to recover them.

The safety barrier may be provided with detection means that are sensitive to the position of the barrier on the rotor. Operation of the acoustic assembly may be prevented if poor positioning, which runs the risk of projectile loss, is detected. The detection means may comprise one or more resistive, capacitative, inductive, optical, or other sensors or contactors.

The safety barrier may be fixed on the rotor in a variety of manners, for example by radial expansion or using at least one locking element which may, for example, bear on a shoulder of the bore, for example behind a rib forming a projection in the bore.

The safety barrier may also be maintained by other means, such as adhesive tape, an adhesive, or one or more magnets.

The invention may also, inter alia, be applicable to treating a rotor including a plurality of peripheral recesses for fixing blades, for example in a gas or steam turbine, for producing mechanical and/or electrical energy.

The recesses may be treated in succession, each individually, or in groups of recesses.

In accordance with one aspect of the invention, the support system may be arranged to be fixed other than in the current recess to be treated.

The term "current" recess denotes the recess in which the projectiles are located when the acoustic assembly operates and the support system is in position on the machine. Fixing the support system other than in the current recess allows the current recess to be treated in its entirety if desired.

For certain rotors, holes open into the recesses and act, for example, to channel a stream of cooling air or lubricant. It may be desirable to plug any holes of each current recess to be treated in order to prevent projectiles from escaping via the holes during treatment. In certain circumstances, said plugging may advantageously be carried out using a plugging system that is independent of the support system. The fact that the plugging system is independent of the support system may have the advantage of facilitating adaptation of the plugging system to the hole, despite dimensional variations that may be encountered in certain rotors.

The plugging system may in particular comprise at least one plugging member positioned so as to be introduced into a recess other than the current recess.

In one exemplary implementation of the invention, the treatment method may comprise:

automatically detecting complete plugging of a hole; and inhibiting operation of the acoustic assembly if incomplete plugging of the hole is detected.

This may avoid the need for the operator to make time-consuming verifications and increase machine down-time.

Detection may be carried out because a plugging member may include at least one contactor arranged to change state when the plugging member is in a hole-plugging configuration.

In one implementation of the invention, a treatment chamber may be defined by the acoustic assembly and the region to be treated, the method comprising:

automatically detecting sufficient closure of the treatment chamber to prevent projectiles from departing; and inhibiting operation of the acoustic assembly in the event of insufficient closure of the treatment chamber.

In one exemplary implementation of the invention, the method may comprise:

introducing projectiles into a treatment chamber at least partially defined by the acoustic assembly and the region to be treated, the projectiles initially being at a distance from a vibrating surface of the acoustic assembly; and initiating movement of projectiles by injecting at least one jet of compressed air into the treatment chamber to project them at least partially against the vibrating surface.

The projectiles may be introduced manually or automatically into the treatment chamber, the operator displacing, for example, a movable closure means in the treatment chamber between a first position for confining projectiles away from the region to be treated and a second position allowing projectiles to reach the region to be treated.

In one implementation, the movable closure means is prevented from being displaced into the second position when the detection means present in the unit indicates a risk of projectile loss.

By way of example, a closure locking member may be provided for this purpose, for example when the closure is manually displacable. When the closure is displaced automatically, control of its displacement may be deactivated when the above-mentioned risk exists.

Means for detecting a risk of projectile loss may be positioned on the elements for forming the primary chamber which co-operates with the vibrating surface and the treated region to define the treatment chamber where the projectiles are imprisoned throughout treatment.

Other detection means may also be located on elements for forming a secondary chamber located outside the primary chamber.

The invention also provides a shot peening unit for treating a rotary machine including an at least partly assembled rotor, the unit comprising:

a support system; and an acoustic assembly carried by the support system;

the support system allowing the acoustic assembly to be fixed to the machine without completely dismantling the rotor, for example without extracting the rotor from the machine.

The term "fixing the acoustic assembly to the machine" means that the support system can if necessary be fixed to the rotor alone when it has been removed from the stator but has not been completely dismantled.

In the presence of recesses at the periphery of the rotor, the fixing system may be arranged to be fixed other than in the current recess to be treated, for example in an adjacent recess.

The support system may include a portion arranged to be fixed to the rotor, for example in a central bore thereof. Fixing may, for example, be assured by expansion of a portion of the support system.

The support system may comprise at least one hinge allowing rotation of the acoustic assembly about an axis of rotation coinciding with the axis of rotation of the rotor.

The support system may include a centering system which can cause an axis of rotation of the acoustic assembly coincide with the axis of rotation of the rotor.

The support system may be arranged to allow displacement of the acoustic assembly along the longitudinal axis thereof and/or to allow the orientation of the longitudinal axis of the acoustic assembly to be adjusted, in particular its orientation relative to the axis of rotation.

These adjustment means allow the acoustic assembly to be displaced relative to the support system as a function of the shape of the machine and that of the region which is to be shot peened.

As mentioned above, the support system may comprise elements for forming a primary chamber, defining the treatment chamber with the vibrating surface and the treated region.

These elements for forming the primary chamber may be provided with at least one detector for detecting sufficient sealing of the treatment chamber, for example for detecting whether the clearance between at least one element for forming the primary chamber and the part to be treated is smaller than the dimensions of a projectile, in particular less than or equal to half the diameter of a projectile.

The support system may also include elements for forming a secondary chamber, outside the primary chamber, intended to provide additional protection against the risk of accidental departure of a projectile from the treatment chamber formed by the primary chamber.

These elements for forming the secondary chamber may include at least one detector for detecting sealing of the secondary chamber sufficient to prevent the projectiles from departing, for example for detecting that the elements for forming the secondary chamber are bearing against the machine to be treated and/or the support system.

The detectors used both for the elements for forming the primary chamber and those for forming the secondary element may comprise at least one contactor, for example of the micro-switch type, or an inductive, capacitative, resistive, or even optical sensor.

The elements for forming a primary or secondary chamber may be biased towards a position for closing the secondary chamber by at least one resilient return member such as a spring, for example.

The unit may include a system for providing protection against external shocks, defining a space containing the acoustic assembly. This shock protection system may be sealed to projectiles, being intended at least to limit the risk of accidental collision of an operator or an object against the acoustic assembly, which collision could modify the position of the acoustic assembly and/or the support system relative to the machine and cause an accidental loss of projectiles.

The shock protection system may include a lower non-perforate portion to recover a projectile that has dropped into it. The bottom portion of said non perforate portion may be terminated by a projectile recovery stopper.

The shock protection system may include, in its top portion, one or more bars, or a screen, or a transparent wall in order to provide visual access to the acoustic assembly.

The shock protection system may be provided with detection means to detect proper positioning of the protection system relative to the machine to be treated.

These detection means may, for example, comprise a detector that is sensitive to the protection system bearing against the machine, for example a contactor that changes state by bearing on the rotor when the system is correctly positioned.

As mentioned above, the unit may include a safety barrier to be disposed in a bore of the rotor to close it.

The support system may include at least one detector that inhibits operation of the acoustic assembly in the event of poor positioning of the support system.

When the support system is intended to be fixed in the bore of the rotor, said detector may, for example, comprise a contactor which changes state on coming to bear against the rotor when the support system is correctly positioned.

The unit may also, for example, be arranged to treat the central core of the rotor or the recesses located at the periphery of the rotor.

The support system may comprise an arm, which may optionally be hinged, the end of which is arranged to be fixed by mechanical cooperation in a recess adjacent to the current recess. This arm may, for example, include an end having a shape which is complementary to the recess and is engaged therein by a sliding movement.

The support system may comprise one or more slides which allow the acoustic assembly to be displaced relative to the current recess to move towards or away from the bottom of the recess and/or to displace it along the recess.

The unit may include one or more closure elements that are placed in the current recess and/or close thereto, to define a treatment chamber. At least some of the closure elements are, for example arranged to follow the shape of one or more flanks of the current recess.

When the support system is arranged to allow displacement of the acoustic assembly along the longitudinal axis of the current recess, the unit may include one or more closure elements arranged to slide in the recess and that are disposed either side of a vibrating surface of the acoustic assembly.

Said closure elements may be displaced along the recess during treatment thereof, being, for example, integral with the acoustic assembly and/or with part of the support system.

The unit may comprise a plurality of acoustic assemblies.

The unit may comprise a plurality of sonotrodes disposed side by side with, where appropriate, clearance between them that is smaller than the diameter of a projectile. These various sonotrodes disposed side by side may follow a curvilinear path in order to treat a recess with a longitudinal axis that is curvilinear.

The sonotrodes are, for example, supported by acoustic stacks connected by a holding piece. Each acoustic stack is fixed to the holding piece, for example at a vibration node for the acoustic assembly.

At least two sonotrodes may have vibrating surfaces from which the projectiles ricochet, which surfaces are substantially rectangular in shape, with the long side orientated along a major axis.

The major axes of two adjacent sonotrodes may make an angle between them. A seal may be disposed between two adjacent sonotrodes to prevent projectiles from becoming stuck between the sonotrodes and/or to reduce surface discontinuities between the sonotrodes.

In another aspect, the invention provides an acoustic assembly comprising a plurality of sonotrodes disposed side by side. The axes of the acoustic assemblies comprising these sonotrodes may be non coplanar while remaining parallel to each other. For example, said axes intersect the longitudinal axis of a recess to be treated, in which the sonotrodes are partially engaged.

The sonotrodes may have vibrating surfaces with substantially rectangular shapes. A seal may be disposed between two adjacent sonotrodes, said seal possibly being wedge-shaped.

BRIEF DESCRIPTION OF THE DRAWINGS

The invention can be better understood from the following detailed description of non-limiting implementations thereof, and from an examination of the accompanying drawings, in which:

FIGS. 3 to 7 are fragmentary and diagrammatic axial sections showing examples of the positioning of the support system and of the acoustic assembly relative to examples of rotors;

FIG. 8 is a diagram showing an example of a safety barrier in isolation and in axial section;

FIG. 9 is a diagrammatic rear view along IX of FIG. 8;

FIG. 10 is a diagrammatic rear view of another example of a safety barrier;

FIGS. 11 and 12 are fragmentary and diagrammatic sections respectively on XI-XI and XII-XII of FIG. 10;

FIG. 13 shows a detail of the barrier of FIG. 10;

FIG. 14 is a fragmentary and diagrammatic axial section of another example of a safety barrier;

FIG. 15 is a diagrammatic perspective view of a system for providing protection against external shocks, which system may be included in a unit of the invention;

MORE DETAILED DESCRIPTION

Figure 1:
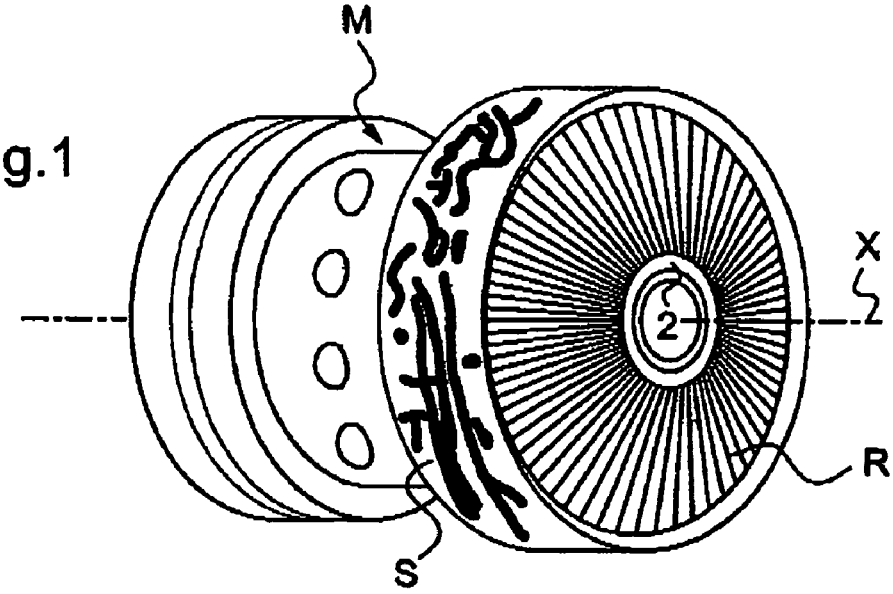
FIG. 1 shows, in partial perspective diagrammatic form, an example of a machine which may undergo a shot peening treatment of the invention.

The rotary machine M shown in FIG. 1 comprises a rotor R that can rotate relative to a stator S about an axis of rotation X.

By way of example, said machine M is a gas or steam turbine, for example an airplane engine, the rotor R of which has not been completely removed from the stator S.

The machine M is in its service environment, for example in a power station or on an airplane wing, when the invention is implemented in situ.

The machine M may also have been dismantled from an aircraft and placed on a cradle, not shown, which may, for example, apply to an airplane engine. The rotor R does not need to have been removed completely from the stator S.

Alternatively, the rotor R may have been removed completely from the stator S, but not completely dismantled.

The machine M may need to be shot peened in a predefined region, for example local shot peening treatment following detection of a crack or defect, or more complete treatment, for example of a leading edge.

In general, the region to be treated may be any region of the rotor R or stator S when the stator is present.

Figure 2:
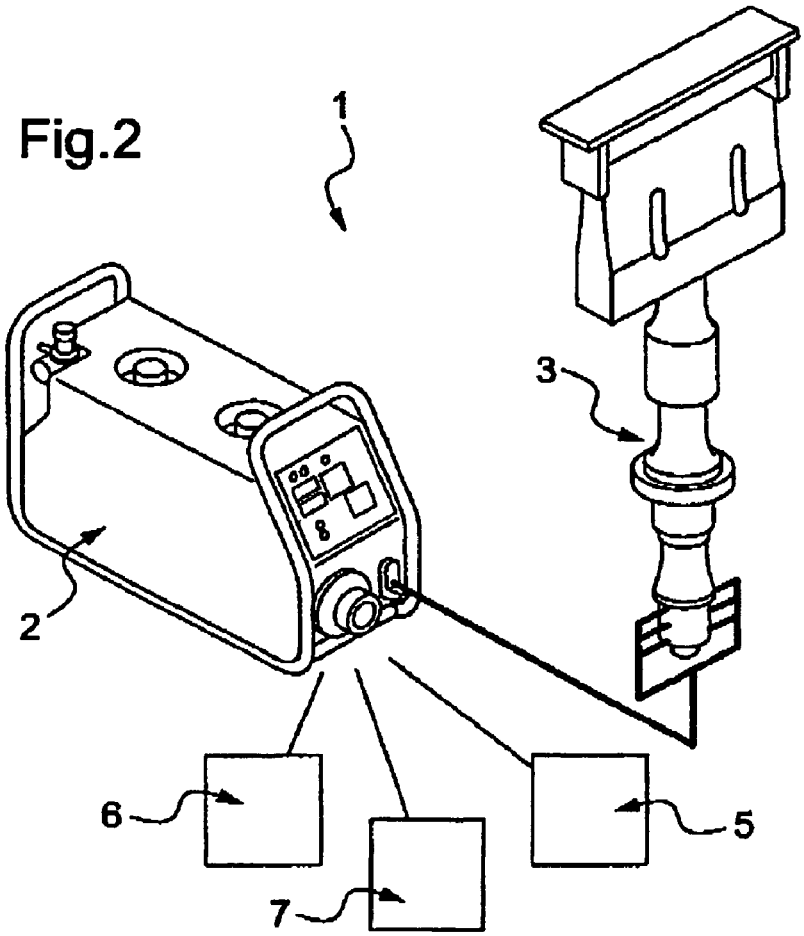
FIG. 2 is a block diagram of an example of a shot peening unit of the invention.

FIG. 2 shows an example of a shot peening unit 1 that can be used to treat a rotary machine such as the machine M shown in FIG. 1.

Said shot peening unit 1 comprises one or more generators 2 which supply one or more acoustic assemblies 3, each comprising one or more sonotrodes.

An acoustic assembly typically comprises a piezoelectric transducer (also known as a converter) which transforms an electric current delivered by the generator 2 into mechanical waves. The vibration amplitude of the piezoelectric transducer is amplified using one or more acoustic stages (also termed boosters) up to the last part of the stack that constitutes the sonotrode and that defines the vibrating surface. The sonotrode may be arranged to vibrate relatively uniformly over the whole of its vibrating surface.

Together with the treated part, the unit defines at least one treatment chamber containing projectiles, for example spherical beads with diameter in the range 0.3 mm [millimeters] to 5 mm. The density of the projectiles is, for example, in the range 2 g/cm$^3$ [grams per cubic centimeter] to 16 g/cm$^3$. The quantity of projectiles is, for example, in the range 0.2 g [grams] to 50 g. The hardness of the projectiles is, for example, in the range 200 HV [hardness Vickers] to 2000 HV.

Where appropriate, the generator 2 may be arranged to control drive means 5 for at least one acoustic assembly 3, as is described below, to displace the acoustic assembly relative to the machine M and to treat an extended region of the machine M.

The unit 1 may include optional means 6 for injecting compressed air into the treatment chamber or towards it, to initiate movement of the projectiles.

The unit 1 may also include detection means 7 that can prevent the operation of the acoustic assembly under certain conditions, for example when there is a risk of accidental departure of projectiles.

The unit 1 may be used to treat various regions of the machine M and, for example as shown in FIGS. 3 to 6, an edge 10 located at the junction of a first surface 11, which is frontal, orientated substantially perpendicular to the axis of rotation X, and a second surface 12, which is cylindrical, concentric with the axis of rotation X.

Said edge 10 may be sharp, chamfered, and/or rayed or it may have undergone a repair treatment by machining and polishing.

In the example shown, the rotor R includes a central bore 21 which may have various profiles and which operates, for example, as a function of the nature of the machine.

In the example shown in FIG. 7, a surface 90 of the bore 21 is being treated, said surface 90 being, for example, a cylinder of revolution about the axis X. The longitudinal axis Z of the acoustic assembly 3 is, for example, orientated perpendicular to the axis of rotation X.

In FIGS. 3 to 7, the acoustic assembly 3 comprises a sonotrode 15 defining a vibrating surface 16 on which projectiles 17 may ricochet and travel back and forth many times during the operation of the acoustic assembly 3 between the vibrating surface and the region to be treated.

The projectiles 17 move in a treatment chamber 18 which is formed by the sonotrode 15, the region to be treated, and the elements 20 for forming a primary chamber.

The elements 20 for forming a primary chamber are produced from a metallic or non metallic material which allows projectiles to ricochet from them, for example steel, INCONEL®, aluminum, or a plastic material, for example a polyamide, a polyacetal, or polyethylene.

The acoustic assembly 3 is mounted on a support system 23 which is fixed on the machine M.

In the example shown, the support system 23 is fixed on the rotor R and more particularly in the central core 21.

The support system 23 may comprise a first portion 22 which is stationary relative to the rotor and a second portion 25 which can turn relative to the first portion 22 by means of a hinge 28 to allow the acoustic assembly 3 to be displaced relative to the machine M to treat an extended region thereof or to carry out several local treatments.

The first portion 22 of the support system 23 may comprise a mechanism 29 for fixing to the rotor R which may also, where appropriate, allow adjustment of centering to cause the hinge axis 28 to coincide with the axis of rotation X of the rotor.

The mechanism 29 may act by radial expansion or otherwise.

Displacement of the acoustic assembly 3 may be carried out manually, for example by the operator manually turning the second portion 25 relative to the first portion 22.

Figure 3:
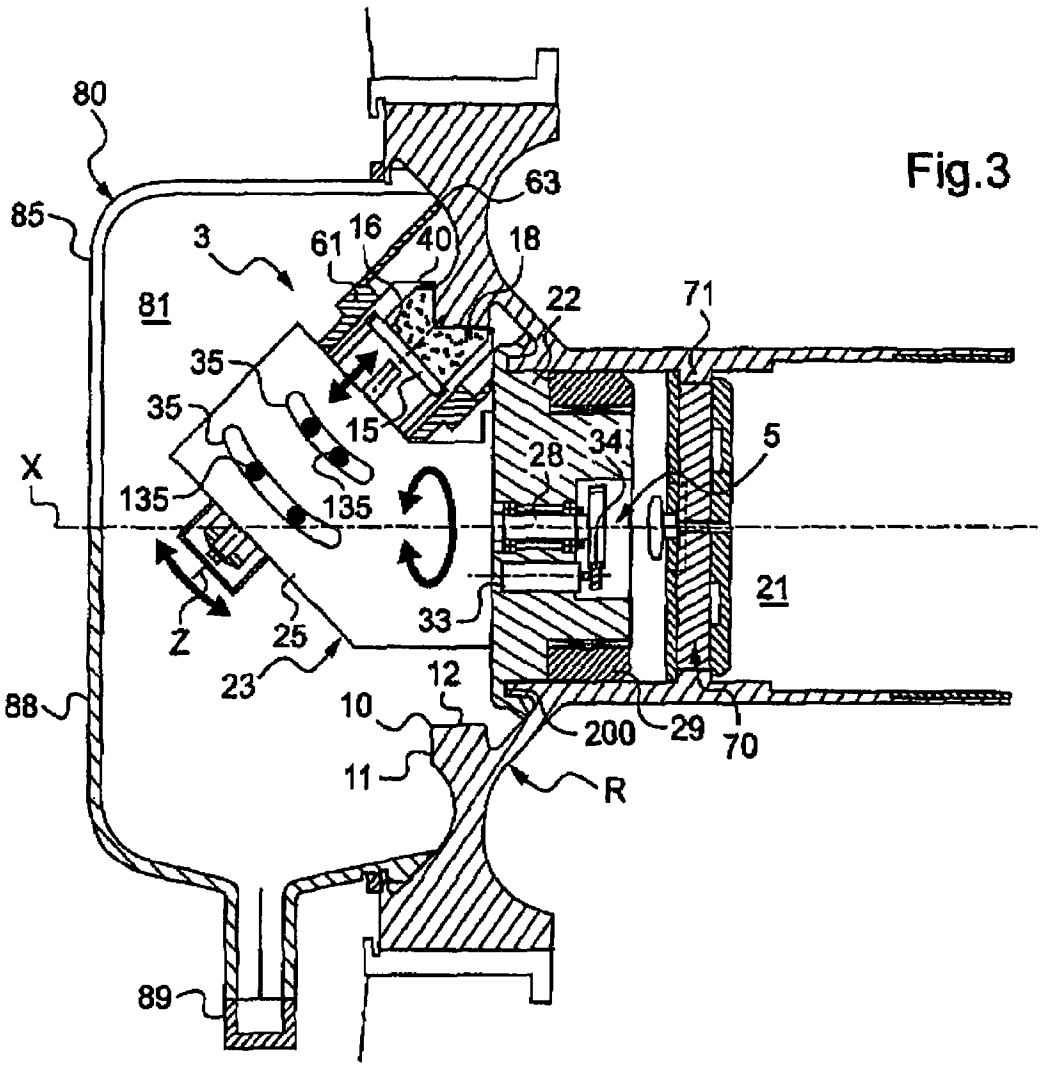

Displacement of the acoustic assembly 3 may also be motorized using the above-mentioned drive means which, for example, comprise at least one motor 33 housed in the first portion 22, as can be seen in FIG. 3.

The second portion 25 supporting the acoustic assembly 3 may, for example, be driven via reduction gearing 34.

Figure 4:
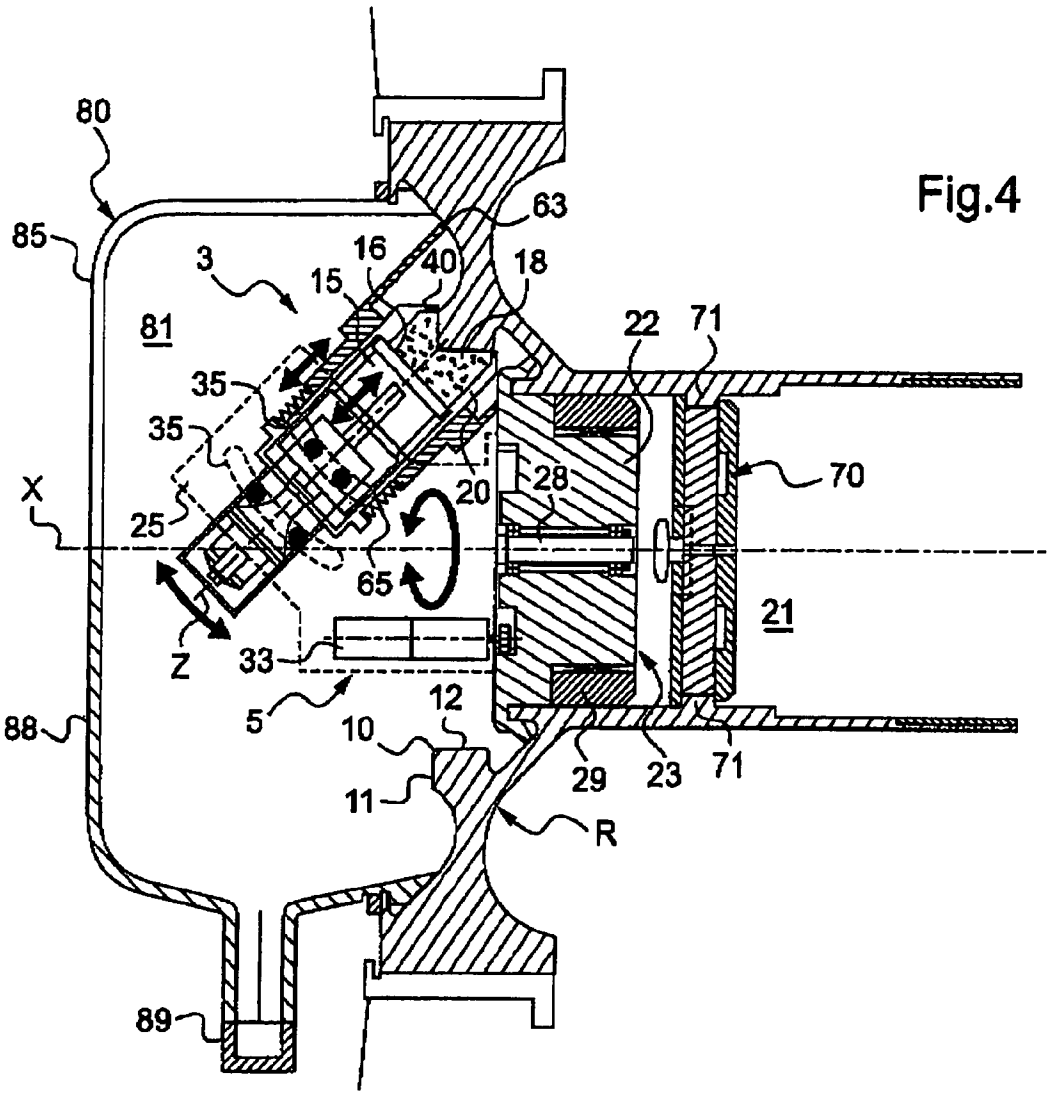
Figure 5:
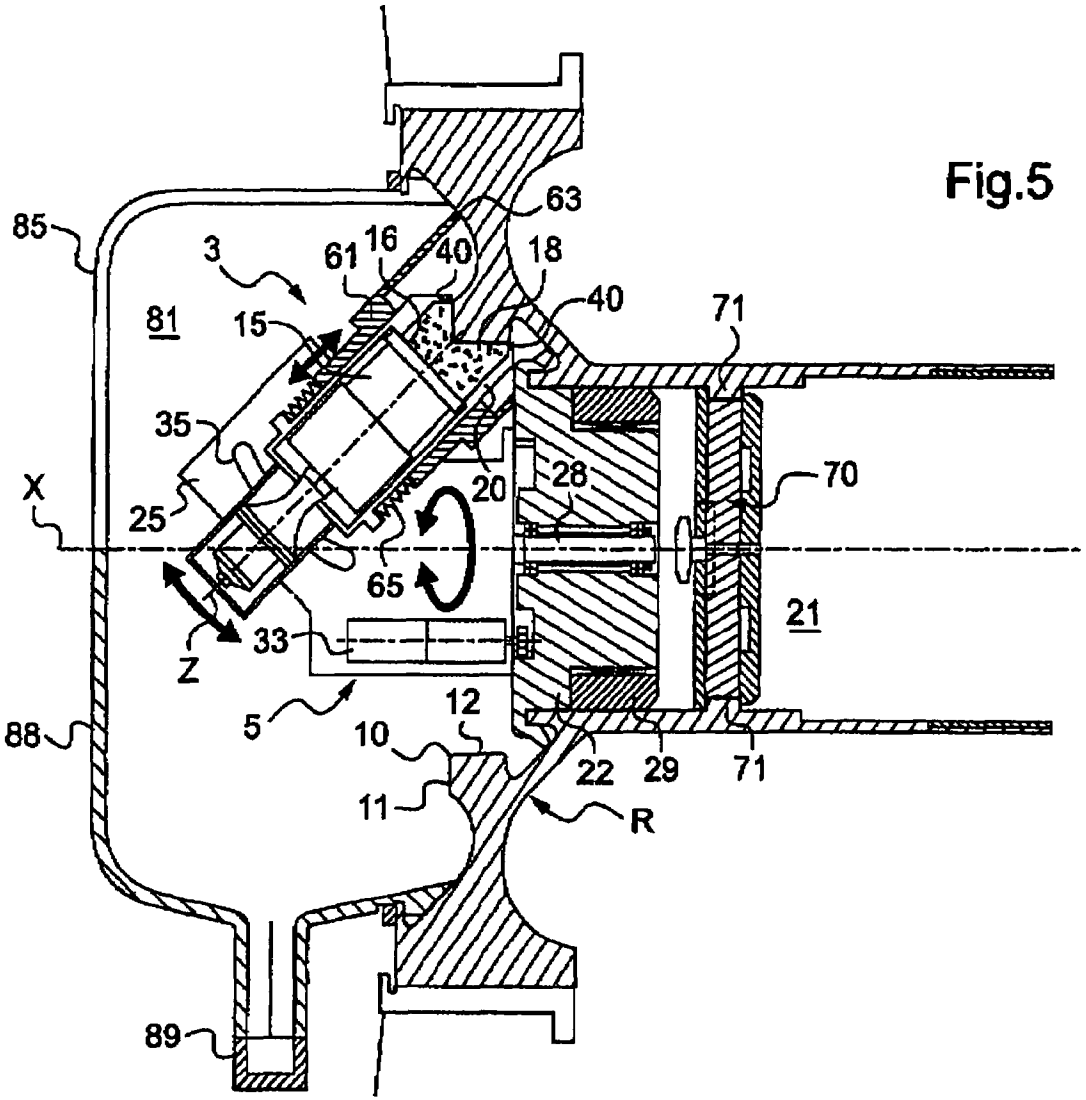
Figure 6:
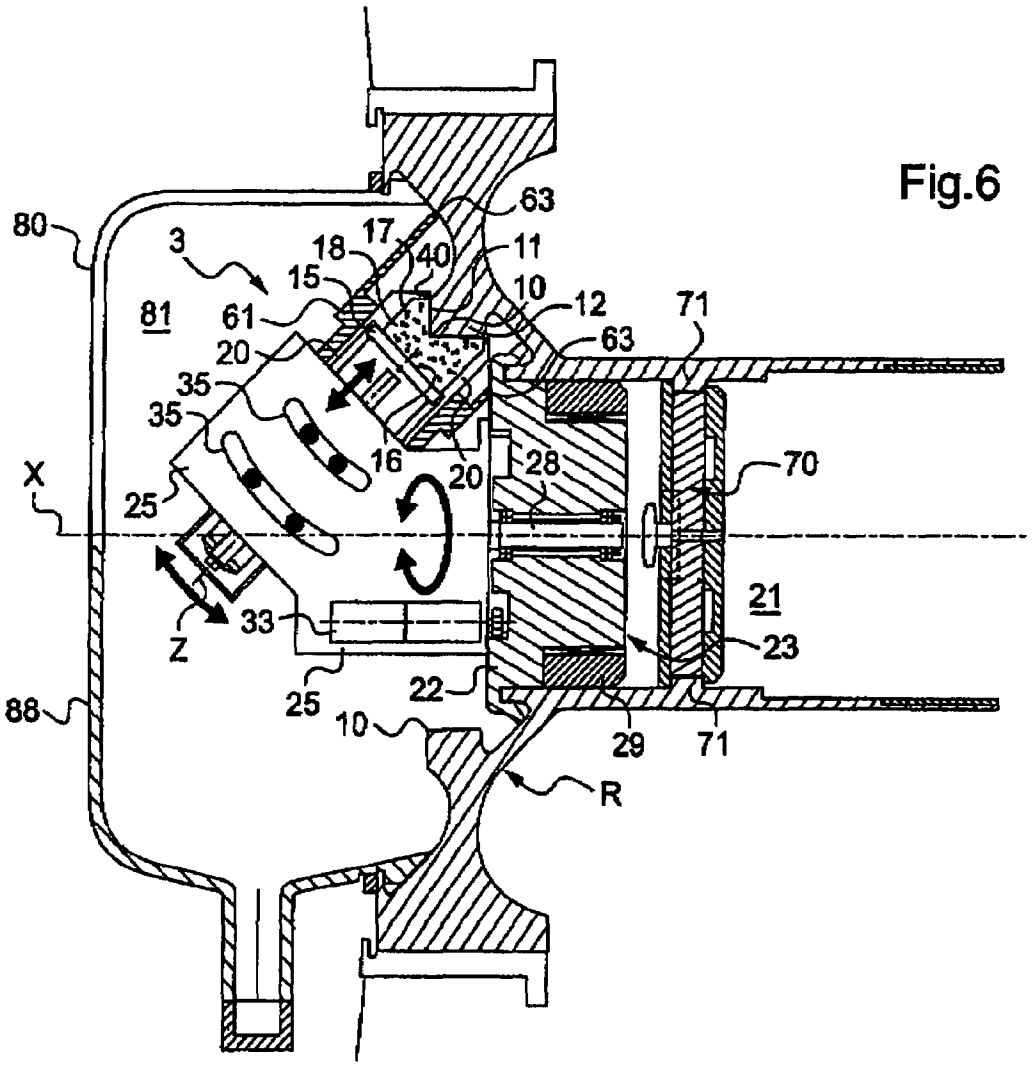

The motor 33 may also be housed in the second portion 25, as shown in FIGS. 4 to 6.

The motor 33 may, for example, be an electric motor powered by the generator 2 in a controlled manner to allow, for example, rotation of the acoustic assembly 3 about the axis of rotation X of the rotor at a predefined speed.

The unit 1 may comprise one or more detectors, not shown, to inform the generator 2 of rotation of the acoustic assembly 3 about the axis X, for example an encoder, which may be optical or magnetic, turning with the shaft of the hinge 28 or with the shaft of the motor 33.

The second portion 25, which supports the acoustic assembly 3, may be produced in a variety of manners as a function, for example, of the shape of the region to be treated.

In a variation, not shown, the drive means 5 comprise a screw or rack allowing axial displacement of the second portion 25 along the axis X.

In the example shown, the second portion 25 allows adjustment of the orientation of the longitudinal axis Z of the acoustic assembly 3 relative to the axis of rotation X, using curvilinear holes 35 and associated fixings 135.

In a variation, not shown, the support system 23 can also allow adjustment of the position of the acoustic assembly 3 along its longitudinal axis Z, for example by means of a rack or a screw.

The elements 20 for forming the primary chamber may come into contact with the treated part or may remain spaced therefrom during operation of the acoustic assembly 3, by a distance which is sufficiently low to prevent the existing clearance to permit the passage of projectiles 17.

The elements 20 for forming the primary chamber may be urged mechanically to bear against the part to be treated by one or more springs, where appropriate.

As indicated above, the unit 1 advantageously includes detection means 5 to detect a breach of security linked, for example, to poor positioning of a mechanical component of the unit.

Said detection means 5 may comprise several detectors located at multiple positions in the unit 1.

In the example under consideration, one or more of the elements 20 for forming the primary chamber comprise detection means 40 which are sensitive to the proximity of the treated part to prevent operation of the acoustic assembly 3 in the event that there is a risk of accidental exit of a projectile from the treatment chamber.

The detection means 40 may, for example, comprise at least one detector disposed at the end of an element 20 for forming the primary chamber and sensitive to the presence of the part to be treated.

As an example, it may be: a contactor, the contactor being actuated by the part to be treated when the element 20 for forming the primary chamber is correctly positioned; or a resistive sensor which is sensitive to electrical contact between the element for forming the primary chamber and the treated part; or an inductive sensor, for example a Hall effect sensor, sensitive to the magnetic field of the part to be treated when it is produced from a magnet material; or a capacitative, or an optical sensor, or otherwise.

The detection means 40 may supply an electric signal to the generator 2, which generator is arranged to indicate a defect in operation to the operator and to prevent operation of the acoustic assembly 3 in the event of poor positioning of at least one of the elements 20 for forming the primary chamber.

The support system 23 may also include detection means, not shown in the figures, which can detect correct positioning of the first portion 22 in the bore 21 of the rotor R.

These detection means may in particular be arranged to detect the position of the support system relative to the rotor to avoid any risk of a projectile passing through the clearance left between the support system 23 and the bore 21 of the rotor.

Said detection means comprise, for example, one or more contactors, not shown, which change state when bearing on the bore or on a rib 200 or the rotor R.

The unit may, as shown, include a secondary chamber 60 formed around the treatment chamber 18 to further reduce the risk of accidental loss of a projectile 17.

Said second chamber 60 may be defined by elements 61 for forming a secondary chamber which may, for example, be applied to the part to be treated M and/or the support system 23.

Said elements 61 for forming a secondary chamber may, where appropriate, include a return system 65, shown in FIGS. 4 to 7, which can ensure constant contact against the part to be treated and/or the support system 23. Said return system 65 may comprise one or more springs.

Like the elements 20 for forming the primary chamber, the elements 61 for forming the secondary chamber may be provided with detection means 63 to detect contact or approach of said elements 61 to the treated part and/or the support system 23.

The unit 1 may be arranged to prevent operation of the acoustic assembly 3 in the case of non detection of sufficient closure of the secondary chamber 60.

The detection means 63 are, for example, selected from resistive, inductive, capacitative, optical or other sensors or contactors.

The detection means 63 may be of the same nature as the detection means 40.

In one aspect of the invention, additional protection means may be employed to further reduce the risk of accidental loss of a projectile.

In the example shown, a safety barrier 70 is positioned in the bore 21 of the rotor behind the support system 23.

Said safety barrier 70 is, for example, arranged to be fixed on a portion in relief of the rotor, for example a rib 71 which projects into the bore 21 of the rotor.

In variations which are not shown, the safety barrier 70 may be arranged to be fixed on another portion in relief of the rotor, for example a groove, or even to be fixed in the bore 21 in the absence of a particular portion in relief thereof.

The safety barrier 70 may be fixed in the rotor R by locking elements 73, for example, which can be rotated, for example as showed in FIGS. 8 and 9, between an unlocked position and a locked position in which they bear on a rear flank of the rib 71, the safety barrier 70 optionally having a collar 74 which bears on a front flank of the rib 71.

The locking elements 73 may be displaced using tab handles 75, for example.

Rather than turning, the locking elements 73 may also be slidably mounted.

As an example, FIGS. 10 and 12 show locking elements 76 which slide in corresponding grooves 77 of the safety barrier 70 and which may be displaced using a cam 78 which is driven in rotation by a tab handle 79.

The locking elements 76 may be displaced against the action of springs 82, as shown in FIG. 13.

FIG. 14 shows another example of a safety barrier 70 in which fixing on the rotor R is carried out by expanding an annular seal 90 lodged between the body 91 of the safety barrier 70 and an end plate 92 into which a rod 93 has been screwed. The rod may be driven in rotation by a tab handle 94.

On turning the tab handle 94, the space between the end plate 92 and the body 91 and thus compression of the seal 90, may be altered, said compression resulting in a radial expansion which ensures that the safety barrier 70 is sealed in the bore 21.

The safety barrier 70 may be independent of the support system 23, as shown.

In a variation, the safety barrier 70 may be linked to the support system 23.

The safety barrier 70 may include detection means that are sensitive to proper positioning of the rotor R in the bore.

Said detection means comprise, for example, a contactor that changes state when bearing against the rib 71. A plurality of contactors may be linked together and circumferentially distributed on the safety barrier 70.

An electric cable, not shown, may connect the detection means of the safety barrier 70 to the support system 23 or the generator 2 so that the generator can prevent operation of the acoustic assembly if the safety barrier 70 is poorly positioned.

The unit 1 may comprise a system 80 for protection against external shocks which defines a space 81 containing the acoustic assembly 3.

The protection system 80 may optionally be impervious to projectiles and may, for example, comprise bars 85, a screen, and/or a shell formed from transparent thermoplastic material or glass.

The protection system 80 may, for example, be fixed on the rotor or the stator, or it may not be fixed to the machine but simply placed in front of it.

The protection system 80 may comprise, in its lower portion, a receptacle 88 for recovering projectiles and provided in its lower portion with a stopper 89 which may be opened to recover the projectiles.

The protection system 80 may be provided with means for detecting its correct position on the machine, said detection means comprising one or more contactors which changes state in contact with the machine M, for example.

FIG. 15 shows a protection system 80 fixed on the machine M by means of a fixing system actuated by one or more tab handles 95.

Said fixing system comprises, for example, one or more elements for pressing tightly against the rotor R or the stator S.

Figure 16:
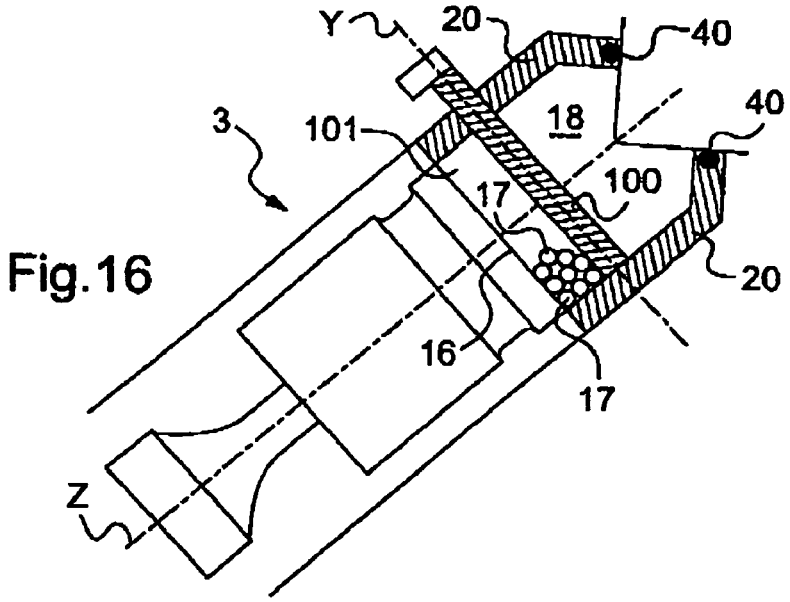
FIG. 16 shows an acoustic assembly provided with a projectile-confinement plug.

As shown in FIG. 16, the acoustic assembly 3 may include closure means 100 that can confine projectiles 17 in a space 101 before operation of the acoustic assembly 3 begins. The closure means 100 comprises a wall 100, for example, which may slide along an axis Y which is, for example, perpendicular to the longitudinal axis Z of the acoustic assembly 3 between a closed position shown in FIG. 16 and a disengaged position in which the vibrating surface 16 of the sonotrode is completely facing the region to be treated.

The closure means 100 may be displaced manually after positioning the acoustic assembly 3 in front of the appropriate region of the machine.

Where appropriate, a locking member controlled by the generator 2 may prevent the closure means 100 from being displaced while satisfactory closing of the treatment chamber 18 and possibly proper positioning of the other components of the unit have not been detected, said locking member being, for example, electromagnetically controlled by the generator 2.

In a further variation, the closure means 100 is displaced in a motorized manner by the generator 2 after verifying that all of the components of the unit are correctly installed.

The invention can treat a rotor including a plurality of peripheral recesses A as showed in FIGS. 17 to 21, for example.

Figure 18:
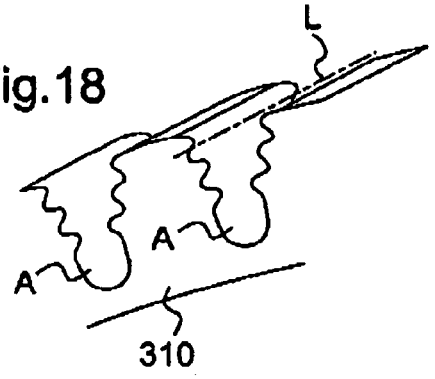
FIGS. 18 to 21 show different recess shapes.
Figure 19:
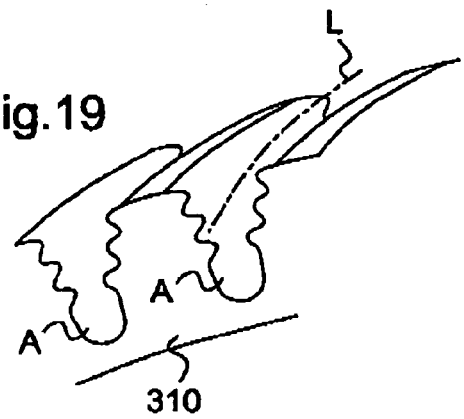
Figure 20:
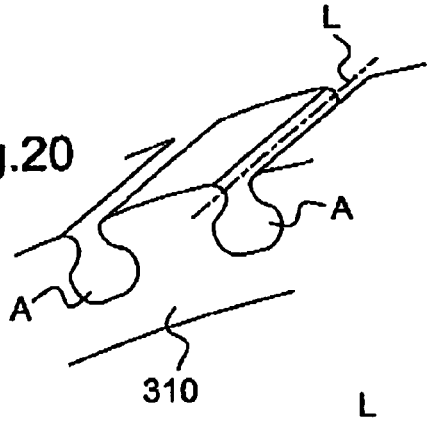
Figure 21:
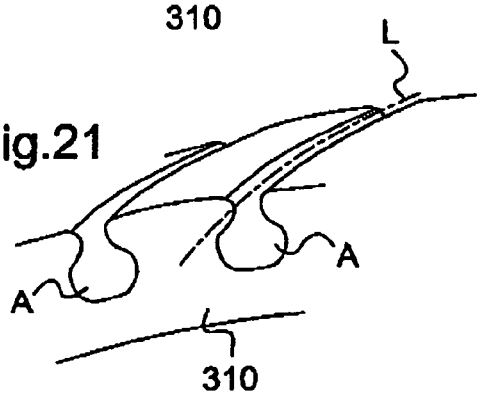

Said recesses A may each have a longitudinal rectilinear axis L, as can be seen in FIGS. 18 and 20, or it may be curvilinear as shown in FIGS. 19 to 21, for example.

The recesses A may have various shapes, for example a shape with a dovetail profile as shown in FIGS. 20 and 21, or with undulating flanks, as can be seen in FIGS. 18 and 19.

Figure 17:
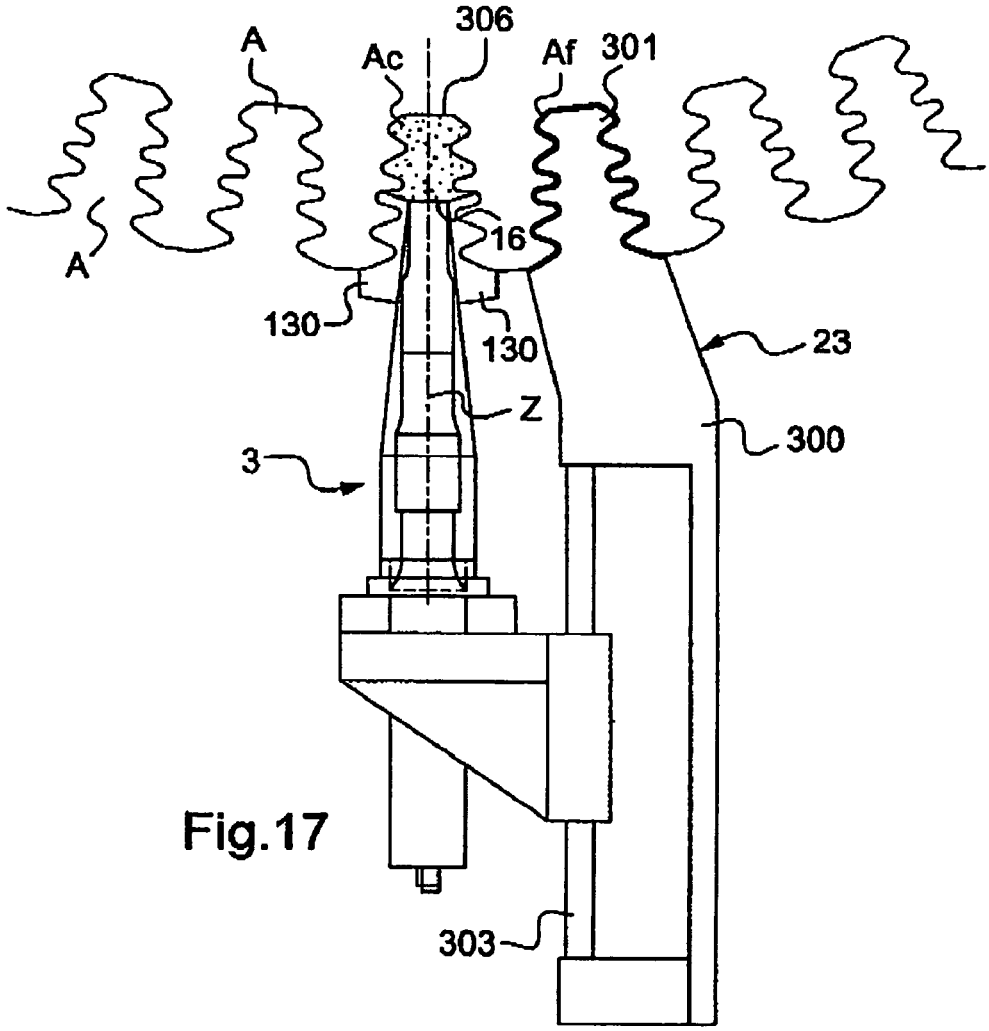
FIG. 17 shows a variation for the treatment of peripheral recesses.

The support system 23 may be fixed in a recess $A_f$ adjacent to the current recess $A_c$ to be treated, as shown in FIG. 17.

To this end, the fixing system 23 may comprise an arm 300 with an end 301 the profile of which is substantially complementary to that of the recess $A_f$.

The fixing system 23 may comprise at least one slide 303 which can displace the acoustic assembly 3 axially along its longitudinal axis Z in order, for example, to adjust the distance separating the vibrating surface 16 of the sonotrode from the bottom 306 of the current recess.

Figure 26:
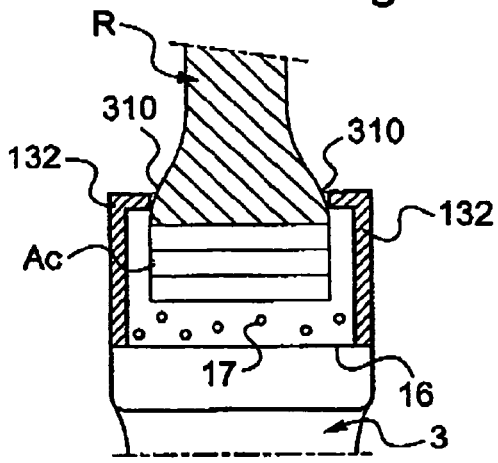

In the example shown, the unit includes elements 132 for forming the primary assembly that can be seen in FIG. 26, which elements axially close the treatment chamber along the longitudinal axis L of the current recess.

Said elements 132 for forming the primary chamber may, for example, be applied against the flanks 310 of the rotor onto which the recesses A open.

In FIG. 26, there can be seen the possibility of the sonotrode being external to the current recess $A_c$.

The acoustic assembly 3 may comprise a sonotrode which extends over the whole length of the recess.

Using a single sonotrode is especially suitable when the longitudinal axis of the current recess $A_c$ is rectilinear.

Figure 27:
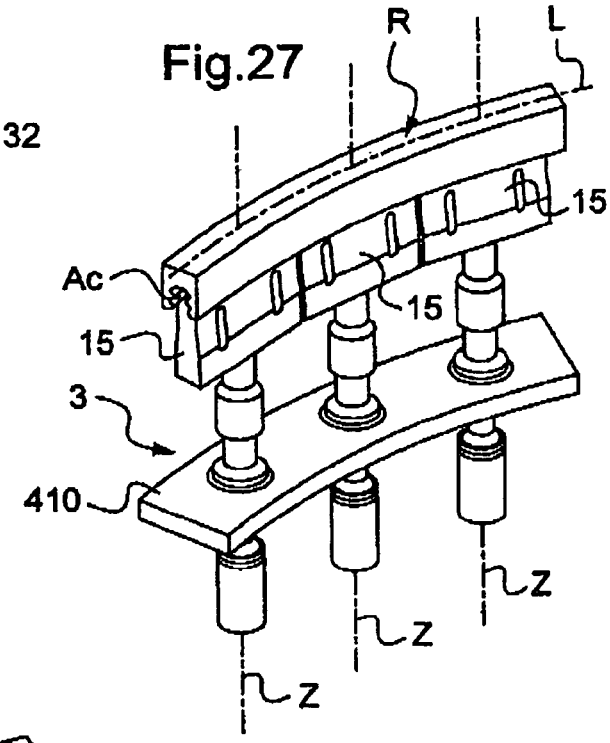
FIGS. 27 and 28 show examples of acoustic assemblies with multiple sonotrodes.
Figure 28:
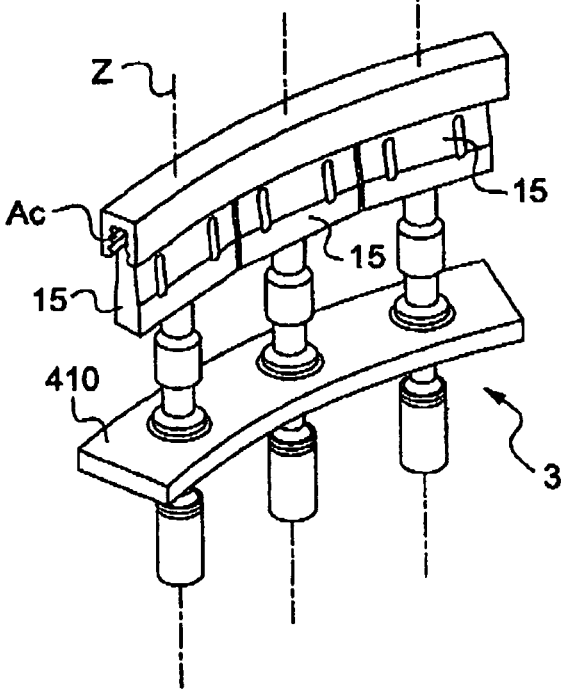
Figure 29:
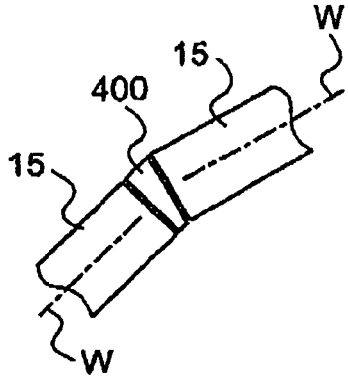
FIG. 29 is a top view along the longitudinal axis of acoustic assemblies, showing a wedge-shaped seal being disposed between two adjacent sonotrodes.

When a recess extends along a curvilinear longitudinal axis L, several sonotrodes 15 may be disposed side by side, as shown in FIGS. 27 to 29, the longitudinal axes Z of the acoustic stacks being non coplanar and mutually parallel, for example.

FIG. 29 shows that the major axes W of the sonotrodes may make an angle between them. A wedge-shaped seal 400 may be disposed between two adjacent sonotrodes 15 to provide surface continuity and prevent projectiles passing between the sonotrodes 15. Using multiple sonotrodes 15 may benefit from treatment of high intensity while being able to treat a complex shape while ensuring that the shapes of the sonotrodes are relatively easy to machine.

Figure 22:
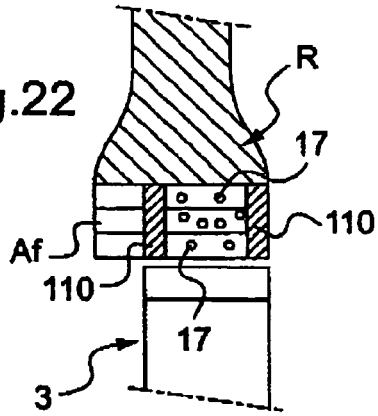
FIGS. 22 to 26 show different shapes for the treatment chambers.

The acoustic assemblies may be fixed via a part 410 having through holes for passing the various stacks. These stacks may be fixed to the part 410 at a vibration node.

Where appropriate, the unit 1 may include chamber-forming elements 110 which define axially, relative to the longitudinal axis L, the treatment chamber inside the current recess $A_c$, as shown in FIG. 22, to prevent projectiles from leaving it.

The acoustic assembly 3 may be kept stationary relative to the recess $A_c$ during treatment thereof. In a variation, the acoustic assembly 3 may be mounted with the possibility of displacement relative to the support system to be able to be displaced relative to the current recess $A_c$.

Such displacement may, for example, allow the sonotrode to be engaged in the recess and to progressively treat it while it is being displaced, and while still following its longitudinal axis L.

Figure 23:
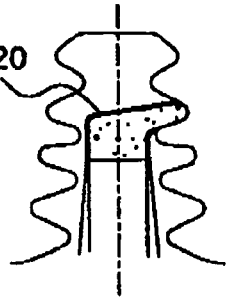

When the sonotrode or sonotrodes are at least partially engaged in the current recess $A_c$, as shown in FIG. 17 or 27 and 28, one or more adapter parts 120 may be introduced with the sonotrode or sonotrodes into the current recess $A_c$ to divert projectiles towards the region to be treated, as shown in FIG. 23.

The treatment chamber may be closed in the current recess $A_c$ by means, for example, of one or more closure elements 130 which are applied to the flank or flanks of the current recess, as shown in FIG. 17.

Figure 24:
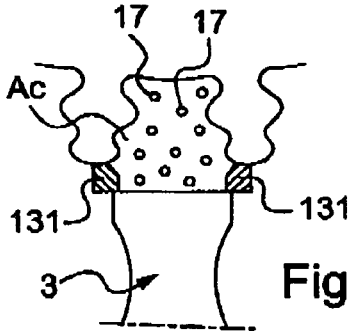
Figure 25:
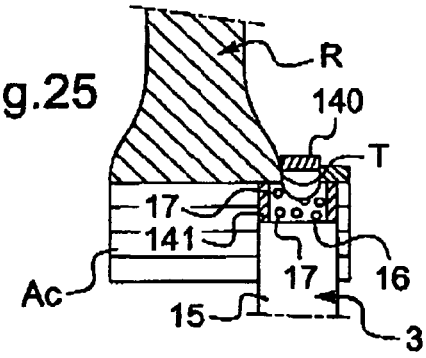

When the sonotrode remains outside the current recess, the treatment chamber may be defined by closure elements 131, e.g. for pressing against the rotor surface between the recesses, as shown in FIG. 24.

When the current recess $A_c$ includes a hole T, it may be plugged by a plugging element 140 which may be located in a variety of manners in the hole T, for example from the current recess or via the hole of an adjacent recess.

Where appropriate, the plugging element 140 includes detection means which can detect its correct positioning in the hole T. These detection means comprise, for example, a contactor that changes state when the plugging element 140 bears against the wall of the hole T or an adjacent wall. The generator 2 may be arranged to prevent the operation of the acoustic assembly or assemblies 3 in the event that it detects that the plugging element 140 is not positioned properly.

The treatment chamber may be defined by elements 141 for forming a primary chamber, which can define the treatment chamber around the hole T.

In all of the above examples, before operating an acoustic assembly 3, its vibrating surface 16 may be orientated upwardly or downwardly.

When the vibrating surface 16 is orientated upwardly, the projectiles 17 may reach the vibrating surface 16 under gravity, which can initiate their motion.

When the vibrating surface is orientated downwardly or obliquely, at least one air jet may be directed towards the projectiles 17 to initiate their movement and bring them into contact with the vibrating surface 16.

Any of the examples described above may include a means 6 for injecting air comprising, for example, a pressurized air inlet channel admitting air into an element for forming the primary chamber, for example, or elsewhere.

Air injection may be controlled by the generator 2, which has, for example, an outlet which can control a solenoid valve for admitting compressed air into the treatment chamber for a predefined period after starting operation of the acoustic assembly.

Where appropriate, a jet of air may be delivered constantly into the treatment chamber in order, for example, to cool one or more of the components of the unit.

A unit of the invention may include counter means for counting the projectiles before operating the acoustic assembly and after the treatment has been carried out.

Said counter means comprise, for example, a suction duct opening into the treatment chamber, via which the projectiles may be sucked in, said projectiles passing in front of a detector suitable for counting them, for example an optical sensor.

The invention is not limited to a particular shape of rotor or stator, nor to a particular region of the machine undergoing shot peening.

The expression "comprising a" should be understood as being synonymous with "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method of shot peening at least a portion of a rotary machine including a rotor, the method comprising:

fixing a support system for supporting at least one acoustic assembly to the machine; and shot peening at least one region of the machine with projectiles that are moved by the acoustic assembly, wherein the support system comprises a pivot allowing the acoustic assembly to rotate at least about an axis of rotation that coincides with an axis of rotation of the rotor, wherein the rotor is at least partly assembled.

2. The method according to claim 1, the acoustic assembly being rotated about the rotor axis through 360°.

3. The method according to claim 2, the acoustic assembly being operated continuous over an entire circumference.

4. The method according to claim 1, in which at least a first treatment of a first region of the machine and a second treatment of a second region of the machine which is spaced circumferentially from the first region are carried out with relative displacement of the machine and the acoustic assembly between the two treatments, operation of the acoustic assembly being interrupted between the two treatments.

5. The method according to claim 1, the support system being fixed on the rotor.

6. The method according to claim 5, the support system being fixed in a central bore of the rotor.

7. The method according to claim 6, wherein proper positioning of the support system in the bore is automatically detected and operation of the acoustic assembly is prevented in the event that positioning is poor.

8. The method according to claim 1, the acoustic assembly being displaced relative to the machine during operation.

9. The method according to claim 1, the method being carried out with a plurality of sonotrodes disposed side by side.

10. The method according to claim 1, the method being carried out in situ, the rotor not being withdrawn completely from the machine.

11. A method of shot peening at least a portion of a rotary machine including a rotor, the method comprising:

fixing a support system for supporting at least one acoustic assembly to the machine; and shot peening at least one region of the machine with projectiles that are moved by the acoustic assembly, wherein the support system includes a motor to drive the acoustic assembly in rotation relative to the rotor, wherein the rotor is at least partly assembled.

12. A method according to claim 1, wherein the rotor is a turbine rotor.

13. The method according to claim 12, wherein the acoustic assembly is positioned facing at least one edge defined by a junction of a surface orientated perpendicular to the axis of rotation of the rotor and a cylindrical surface of revolution about said axis.

14. A method of shot peening at least a portion of a rotary machine including a rotor, the rotor including peripheral recesses serving to fix blades and having holes opening out in the recesses, the method comprising:

fixing a support system for supporting at least one acoustic assembly to the machine elsewhere than in a current recess to be treated;

plugging the holes in each current recess to be treated using a plugging system that is independent of the support system; and shot peening at least one region of the machine with projectiles moved by the acoustic assembly, wherein the rotor is at least partly assembled.

15. The method according to claim 14, wherein the whole of the current recess to be treated is shot peened.

16. The method according to claim 14, the acoustic assembly being displaced along a current recess during its operation.

17. The method according to claim 14, the length of the acoustic assembly being equal to or longer than that of a current recess.

18. The method according to claim 14, the method being carried out with a plurality of sonotrodes disposed side by side.

19. The method according to claim 14, the method being carried out in situ, the rotor not being withdrawn completely from the machine.

20. A method of shot peening at least a portion of a rotary machine including a rotor, a treatment chamber at least partially defined by the acoustic assembly and the region to be treated, the method comprising:

fixing a support system for supporting at least one acoustic assembly to the machine;

shot peening at least one region of the machine with projectiles moved by the acoustic assembly;

automatically detecting closure of the treatment chamber sufficient to prevent projectiles from departing; and inhibiting operation of the acoustic assembly in the event of insufficient closure of the treatment chamber, wherein the rotor is at least partly assembled in a treatment chamber, wherein the treatment chamber is at least partially defined by the acoustic assembly and the region to be treated.

21. The method according to claim 20, the method being carried out with a plurality of sonotrodes disposed side by side.

22. The method according to claim 20, the method being carried out in situ, the rotor not being withdrawn completely from the machine.

23. A method of shot peening at least a portion of a rotary machine including a rotor, the method comprising:

fixing a support system for supporting at least one acoustic assembly to the machine; and introducing projectiles into a treatment chamber at least partially defined by the acoustic assembly and the region to be treated, the projectiles initially being at a distance from a vibrating surface of the acoustic assembly;

initiating movement of projectiles by injecting at least one jet of compressed air into the treatment chamber to project at least some of them against the vibrating surface; and shot peening at least one region of the machine by moving the projectiles with the acoustic assembly, wherein the rotor is at least partly assembled.

24. The method according to claim 23, the method being carried out with a plurality of sonotrodes disposed side by side.

25. The method according to claim 23, the method being carried out in situ, the rotor not being withdrawn completely from the machine.

26. A method of shot peening at least a portion of a rotary machine including a rotor, the method comprising:

fixing a support system for supporting at least one acoustic assembly to the machine;

shot peening at least one region of the machine with projectiles moved by the acoustic assembly; and positioning a system for protection against external shocks in front of the machine and at least partially defining a space containing the acoustic assembly, wherein the rotor is at least partly assembled.

27. The method according to claim 26, the method being carried out with a plurality of sonotrodes disposed side by side.

28. The method according to claim 26, the method being carried out in situ, the rotor not being withdrawn completely from the machine.

29. A method of shot peening at least a portion of a rotary machine including a rotor, the method comprising:

fixing a support system for supporting at least one acoustic assembly to the machine;

introducing a safety barrier into a central bore of the rotor; and shot peening at least one region of the machine with projectiles moved by the acoustic assembly, wherein the rotor is at least partly assembled.

30. The method according to claim 29, the method being carried out in situ, the rotor not being withdrawn completely from the machine.

* * * * *